US006196895B1

(12) United States Patent
Elkins

(10) Patent No.: US 6,196,895 B1
(45) Date of Patent: Mar. 6, 2001

(54) HEAT-ACTIVATED TOY

(76) Inventor: Larry Elkins, 1070 Elkgrove Ave., #4, Venice, CA (US) 90291

( * ) Notice: Subject to any disclaimer, the term of this patent is extended or adjusted under 35 U.S.C. 154(b) by 0 days.

(21) Appl. No.: 09/044,865

(22) Filed: Mar. 20, 1998

(51) Int. Cl.[7] ..... A63H 33/00
(52) U.S. Cl. ..... 446/491; 446/14
(58) Field of Search ..... 446/14, 140, 176, 446/491; 472/54, 72; 40/324, 427

(56) References Cited

U.S. PATENT DOCUMENTS 2,561,217 * 7/1951 Muir .
3,811,990 * 5/1974 Stoff .
3,895,143 * 7/1975 Tarlow .
3,978,608 * 9/1976 Kovachevich .
5,518,433 * 5/1996 Sneddon .

FOREIGN PATENT DOCUMENTS

1091144 * 4/1955 (FR) ..... 446/14

OTHER PUBLICATIONS

"Miracle Fish"Received in the Patent Office by Barry Shay, Nov. 1975.*

* cited by examiner

*Primary Examiner*—Sam Rimell

(57) ABSTRACT

A heat-sensitive toy consisting of variously shaped mylar polyolefin strips prepared by being forcibly drawn across a straight edge so as to assume curved curly shapes and then assembled to form a simulated object such as a serpent, snake or flower. When exposed to a heat source, these simulated objects change the curvature of their parts, curling or uncurling, and conversely return to their original shape when the heat source is removed. Each simulated object is attached to a self-supporting member, designed to display the heat-sensitive toy to advantage.

14 Claims, 1 Drawing Sheet

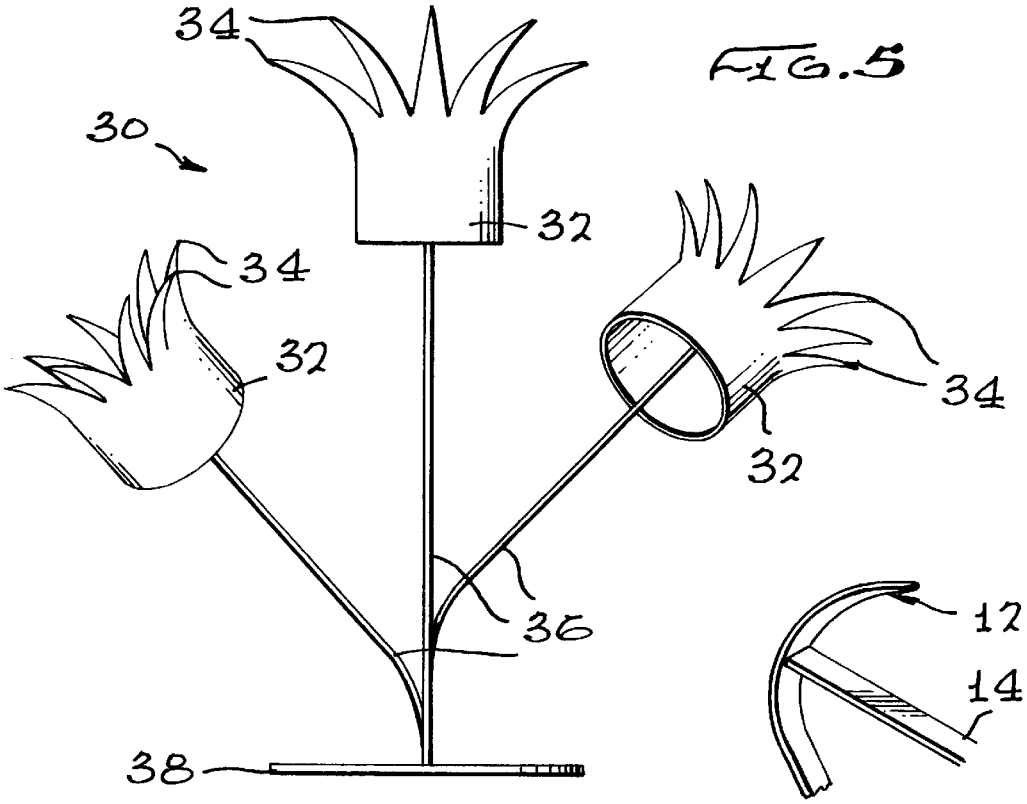
FIG. 5
FIG. 2
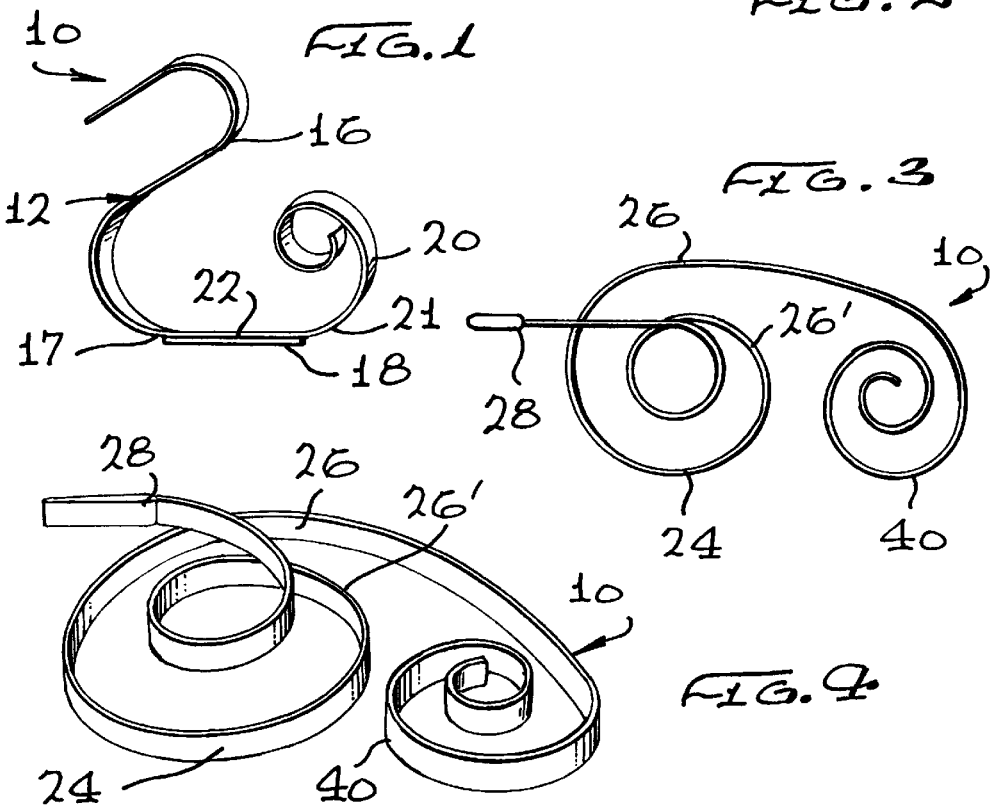
FIG. 1
FIG. 3
FIG. 4

HEAT-ACTIVATED TOY

FIELD OF INVENTION

This invention relates to toys and is particularly directed to toys which move in response to heat.

PRIOR ART

Toys which are self-moving are always a source of interest and enjoyment and numerous types of toys have been proposed which provide movement in response to changes in temperature. Some prior art heat-sensitive toys have employed electromechanical properties to produce movement. However, most of these toys are complex devices and, hence, are relatively expensive to produce and purchase. Other prior art heat-sensitive toys have required electrical coils to be built into the toy. However, such coils involve the possibility of electrical shock to the user and, hence, are undesirable. Still other prior art heat-sensitive toys have been formed of metal-paper laminates which are easily torn. A search in the United States Patent Office has revealed the following:

| U.S. PAT. NO. | INVENTOR | ISSUED |
|---|---|---|
| 2,561,217 | J. O. Muir | Jul. 1, 1951 |
| 5,518,433 | J. Sneddon | May 21, 1996 |
| 4,244,140 | K. Kim | Jan. 13, 1981 |
| 5,687,497 | S. J. Moore | Nov. 18, 1997 |
| 2,562,685 | S. S. Adams | Jul. 31, 1951 |
| 5,022,884 | K. A. Hippley et al | Jun. 11, 1991 |
| 4,881,915 | J. Y. Liaw | Nov. 21, 1989 |
| 2,211,105 | C. J. Dunn | Aug. 13, 1940 |
| 1,677,122 | N. E. Johnson | Jul. 10, 1928 |
| 1,055,439 | C. A. Anderson | Mar. 11, 1913 |
| 2,240,906 | C. Harold | May 6, 1941 |
| 3,089,283 | W. C. Kirkpatrick | May 14, 1963 |

Each of these references is subject to the disadvantages discussed above. Thus, none of the prior art heat-sensitive toys has been entirely satisfactory.

BRIEF SUMMARY AND OBJECTS OF INVENTION

These disadvantages of the prior art are overcome with the present invention and an improved heat-sensitive toy is provided which is simple and inexpensive to produce and purchase, has no mechanical moving parts to break or require maintenance, does not require a built-in electrical coil and yet can be used repeatedly to provide enjoyment over an extended period of time.

The advantages of the present invention are preferably attained by providing an improved heat-sensitive toy comprising at least one heat-responsive moveable strip formed of mylar polyolefin which has been pulled against a straight edge. The mylar polyolefin strip preferably has a portion thereof bonded to a self-supporting member, formed of suitable material, such as paper, plastic, metal or the like.

Accordingly, it is an object of the present invention to provide an improved heat-sensitive toy.

Another object of the present invention is to provide an improved heat-sensitive toy which is simple and inexpensive to produce and purchase.

An additional object of the present invention is to provide an improved heat-sensitive toy which has no mechanical moving parts to break or require maintenance.

A further object of the present invention is to provide an improved heat-sensitive toy which does not require a built-in electrical coil.

Another object of the present invention is to provide an improved heat-sensitive toy which can be used repeatedly to provide enjoyment over an extended period of time.

A specific object of the present invention is to provide an improved heat-sensitive toy comprising at least one heat-responsive moveable strip of mylar polyolefin which has been pulled against a straight edge having a portion thereof bonded to a self-supporting member formed of suitable material, such as metal, plastic, paper or the like.

These and other objects and features of the present invention will be apparent from the following detailed description, taken with reference to the figures of the accompanying drawing.

BRIEF DESCRIPTION OF THE DRAWING

FIG. 1 is a plan view of a heat-sensitive toy embodying the present invention;

FIG. 2 is a diagrammatic representation showing the mylarpolyolefin layer of the heat-sensitive toy of FIG. 1 being drawn over a straight edge;

FIG. 3 is a plan view of another heat-sensitive toy embodying the present invention;

FIG. 4 is an isometric view of the toy of FIG. 3; and

FIG. 5 is a side view of an additional heat-sensitive toy embodying the present invention.

DETAILED DESCRIPTION OF THE PRESENT INVENTION

In that form of the present invention chosen for purposes of illustration, FIG. 1 shows a heat-sensitive toy, indicated generally at 10, having a moveable strip 12 of mylar polyolefin which has been cut in a desired shape and drawn across a straight edge, as seen at 14 in FIG. 3. As seen in FIG. 1, the strip 12 is cut in a generally S-shape, as seen at 16 in FIG. 1, and has one end 17 bonded to a member 18, formed of self-supporting material, such as paper, plastic, metal or the like. and has a moveable spiral tail, formed of mylar polyolefin, as seen at 20 in FIG. 1, bonded to the other end 21 of the self-supporting strip 18. After being drawn across the straight edge 14, the strips 12 and 20 of mylar polyolefin are bonded to the self-supporting layer 18, which is sufficiently rigid to make the toy 10 self-supporting. The strips 12 and 20 will move when the toy 10 is subjected to changes in temperature. The rate and extent of movement of the toy 10 can be controlled by varying the number, rigidity and material of the layers 12 and 20. The mylar polyolefin strips 12 and 20 are bonded to the supporting layer 18 by suitable means 22, such as double-sided adhesive tape, glue, epoxy or the like.

In use, the mylar polyolefin strips 12 and 20 are cut to desired shapes and are drawn across the straight edge 14 to cause the strips 12 and 20 to curve toward the straight edge 14. Thereafter, the strips 12 and 20 are bonded to self-supporting strip 18 to form the toy 10. Subsequently, any change in the ambient temperature will cause the strips 12 and 20 to move, hence, the toy 10 to bend toward or away from the direction of the curl caused by drawing strips 12 and 20 across the straight edge 14. Increases in temperature will cause the strips 12 and 20 and toy 10 to curl further in the direction away from the curl, while decreases in temperature will cause the strips 12 and 20 and toy 10 to bend in the direction of the curl. Even slight temperature changes, such as the heat of a user's hand, will serve to cause substantial movement of the strips 12 and 20 and, hence, of the toy 10. With the S-shape of FIG. 1, the tail 20 will tend to coil or uncoil, depending upon the direction of the temperature change, while the S-shaped body 16 will tend to writhe in vertical directions.

FIGS. 3 and 4 show an alternative form of the toy 10 in which the mylar polyolefin strip 26 is bonded to a supporting layer 24. In this form of the present invention, the neck 26 is formed in a full loop which straightens out and is given a half twist as it joins the head 28, while the tail 40 is coiled. With this form, when heat is applied, the head 26 tends to weave back and forth horizontally, while the tail 18 coils and uncoils.

FIG. 5 show another toy, indicated generally at 30, and embodying the present invention. The toy 30 is in the form of a flower having one or more short cylinders 32 formed of mylar polyolefin, which may be bonded to one or more supporting layers, such as the layers 20 of FIG. 1, and are cut with a plurality of points 34 to form crown shapes. The points 34 are drawn across the straight edge 14 to cause the points 34 to curl outward and downward to form the petals of the flower and the cylinders 32 are supported on stems 36 formed of relatively rigid metal or plastic wire and attached to a suitable base 38. When heat is applied to the toy 30. the points or petals 34 will tend to open and close in a random fashion.

Obviously, numerous other variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A heat-sensitive toy comprising:

at least one flat strip of mylar polyolefin prepared by being forcibly drawn across a straight edge so as to assume a curved curly shape, and a self-supporting member attached to said prepared mylar polyolefin strip, whereby exposure of said prepared mylar polyolefin strip to a heat source changes the shape of said prepared strip randomly to greater or lesser curvature and curl, and removal of said heat source restores said prepared strip to its original shape.

2. The toy of claim 1 wherein said at least one flat strip of mylar polyolefin has a particular shape, and after being prepared, is assembled to form a simulated object.

3. The toy of claim 2 wherein said simulated object is a serpent of general S-shape with a spiral tail.

4. The toy of claim 2 wherein said simulated object is a snake comprising a head, a full-loop body with a half twist near said head, and a coiled tail.

5. The toy of claim 2 wherein said simulated object is a flower having at least one cylinder formed with a plurality of points.

6. The toy of claim 3 comprising a self-supporting member which is a horizontal base.

7. The toy of claim 4 comprising a self-supporting member which is elongated and rigid and curved, and at one end is attached to said full-loop body and at another end is attached to said coiled tail.

8. The toy of claim 5 comprising a self-supporting member which is a horizontal base with relatively rigid upward rising stems, each supporting a said cylinder.

9. The toy of claim 1 wherein said self-supporting member is attached to said prepared strip by means of double-sided adhesive tape.

10. The toy of claim 1 wherein said self-supporting member is attached to said prepared strip by means of a suitable glue.

11. The toy of claim 1 wherein said self-supporting member is attached to said prepared strip by means of epoxy.

12. The toy of claim 1 wherein said self-supporting member is formed of paper.

13. The toy of claim 1 wherein said self-supporting member is formed of metal.

14. The toy of claim 1 wherein said self-supporting member is formed of plastic.

* * * * *